US010149062B2

(12) United States Patent
Zhang et al.

(10) Patent No.: US 10,149,062 B2
(45) Date of Patent: Dec. 4, 2018

(54) LOUDSPEAKER MODULE

(71) Applicant: Goertek Inc, Weifang, Shandong (CN)

(72) Inventors: Zhibing Zhang, Weifang (CN); Gang Chen, Weifang (CN)

(73) Assignee: Goertek Inc, Weifang, Shandong (CN)

( * ) Notice: Subject to any disclaimer, the term of this patent is extended or adjusted under 35 U.S.C. 154(b) by 0 days.

(21) Appl. No.: 15/524,135

(22) PCT Filed: Nov. 18, 2015

(86) PCT No.: PCT/CN2015/094884
§ 371 (c)(1),
(2) Date: May 3, 2017

(87) PCT Pub. No.: WO2016/155326
PCT Pub. Date: Oct. 6, 2016

(65) Prior Publication Data

US 2018/0176690 A1 Jun. 21, 2018

(30) Foreign Application Priority Data

Mar. 31, 2015 (CN) ..... 2015 1 0149270

(51) Int. Cl.
*H04R 9/06* (2006.01)
*H04R 1/06* (2006.01)
(Continued)

(52) U.S. Cl.
CPC ..... *H04R 9/06* (2013.01); *H04R 1/06* (2013.01); *H04R 9/025* (2013.01); *H04R 9/046* (2013.01); *H04R 1/02* (2013.01); *H04R 9/045* (2013.01)

(58) Field of Classification Search
CPC . H04R 9/00; H04R 9/06; H04R 9/025; H04R 9/04; H04R 9/043; H04R 9/045;
(Continued)

(56) References Cited

U.S. PATENT DOCUMENTS 4,539,442 A * 9/1985 Puls ..... H04R 9/045 174/117 FF
8,594,363 B2 * 11/2013 Lee ..... H04R 9/046 381/400
(Continued)

FOREIGN PATENT DOCUMENTS

CN 1630425 A 6/2005
CN 202799135 * 3/2013 ..... H04R 9/06
(Continued)

OTHER PUBLICATIONS

International Search Report of PCT Application No. PCT/CN2015/094884, dated Dec. 29, 2015, 4 pages.

*Primary Examiner* — Oyesola C Ojo
(74) *Attorney, Agent, or Firm* — Maine Cernota & Rardin

(57) ABSTRACT

The present invention disclosed a loudspeaker module, comprising an inner cavity enclosed by a shell, a voice coil and an FPCB installed in the inner cavity, leading wires of the voice coil and a flexible connection part between the leading wires and the FPCB, wherein one end of the flexible connection part is connected with a free end of the leading wires, and the other end thereof is connected with the FPCB; and the flexible connection part is suspended in the inner cavity through the leading wires and the FPCB. In the loudspeaker module of this invention, the leading wires can be vibrated with the flexible connection part, thereby effectively preventing the leading wires from falling and fracturing at the connection position, improving the reliability of the loudspeaker module, and simultaneously avoiding the large space demand and resonance caused by elongated leading wires.

7 Claims, 3 Drawing Sheets

(51) Int. Cl.
*H04R 9/02* (2006.01)
*H04R 1/02* (2006.01)
*H04R 9/04* (2006.01)

(58) Field of Classification Search
CPC ..... H04R 9/046; H04R 9/047; H04R 1/02; H04R 1/06; H04R 31/006; H04R 2209/041
USPC ..... 381/150
See application file for complete search history.

(56) References Cited

U.S. PATENT DOCUMENTS

| | | | | |
|---|---|---|---|---|
| 9,084,052 | B2 * | 7/2015 | Biessy | H04R 1/06 |
| 9,154,865 | B2 * | 10/2015 | Zha | H04R 1/021 |
| 9,167,324 | B2 * | 10/2015 | Yang | H04R 1/02 |
| 9,648,405 | B2 * | 5/2017 | Wang | H04R 1/06 |
| 2005/0254680 | A1 * | 11/2005 | Kitamura | H04R 1/06 381/396 |
| 2006/0120553 | A1 * | 6/2006 | Saito | H04R 1/06 381/398 |
| 2014/0119592 | A1 * | 5/2014 | Choi | H04R 9/025 381/412 |
| 2016/0014524 | A1 * | 1/2016 | Takada | H04R 7/20 381/398 |

FOREIGN PATENT DOCUMENTS

| | | | | |
|---|---|---|---|---|
| CN | 104254044 | A | 12/2014 | |
| CN | 104822111 | A | 8/2015 | |
| EP | 2472905 | A1 | 7/2012 | |
| JP | 2009288322 | * | 12/2009 | G09F 9/00 |

* cited by examiner

LOUDSPEAKER MODULE

RELATED APPLICATIONS

This application is a national phase application filed under 35 USC § 371 of PCT Application No. PCT/CN2015/094884 with an International filing date of Nov. 18, 2015, which claims priority to Chinese Patent Application No. CN 201510149270.3, filed Mar. 31, 2015. Each of these applications is herein incorporated by reference in their entirety for all purposes.

FIELD OF THE INVENTION

The present invention relates to a technical field of sound producing devices, and more particularly, to a loudspeaker module.

BACKGROUND OF THE INVENTION

A loudspeaker is an important acoustic component in electronic equipments, which is a transducer for converting electrical signals into acoustic signals. The existing loudspeaker module comprises a shell, a vibration system and a magnetic circuit system, wherein the vibration system and the magnetic circuit system are configured in the shell, and the vibration system comprises a vibration diaphragm and a voice coil configured on the vibration diaphragm for driving the vibration diaphragm to produce sound, and the voice coil is connected with the system through leading wires for implementing the connection to circuits. In the prior art, the leading wire can be soldered on an injection-molded bonding pad or be directly soldered on a FPCB.

In the above connection structure, the leading wire is easy to fracture when the voice coil is under vibration for a long time as the leading wire is soldered on an injection-molded bonding pad or directly welded on a FPCB. The current solution is to increase the length of the leading wire, but it requires a larger space for wiring, and if the leading wire is too long, it often aggravates the leading wire itself to fracture under the action of resonance.

SUMMARY OF THE INVENTION

One objective of the invention is to provide a new technical solution for a loudspeaker module.

According to a first aspect of the present invention, there is provided a loudspeaker module which comprises an inner cavity enclosed by a shell and comprises a FPCB (Flexible Printed Circuit Board) and a voice coil installed in the inner cavity of the shell. The loudspeaker module further comprises leading wires for the voice coil and a flexible connection part positioned between the leading wires and the FPCB, wherein the free end of said leading wires is connected with one end of the flexible connection part, another end of said flexible connection part is connected with the FPCB, and said flexible connection part is suspended in the inner cavity of the shell through the leading wires and the FPCB.

Preferably, the free end of said leading wires is soldered with the flexible connection part.

Preferably, said flexible connection part and the FPCB are integrated together, which is an extension part from the end of the FPCB to the direction of the free end of the leading wires.

Preferably, said flexible connection part comprises a first planar section which is basically located in same plane with the FPCB and a second planar section which is basically located in same plane with the free end of the leading wires and a connection section connected the first planar section and the second planar section.

Preferably, said shell comprises an upper shell, a middle shell and a lower shell buckled together in sequence, and said FPCB is fixed in the middle shell.

Preferably, an end of said FPCB for connecting the flexible connection part is configured with a positioning hole, and the corresponding position of said middle shell is configured with a prominent positioning column.

Preferably, an end of said FPCB for connecting the flexible connection part is fixed with the middle shell by means of hot melt.

Preferably, an end of said FPCB for connecting the flexible connection part is fixed with the middle shell by a double-sided adhesive.

In the loudspeaker module of the present invention, the leading wires and the FPCB are connected together through the flexible connection part, and the flexible connection part is suspended in the inner cavity of the module. When the voice coil is vibrated, the leading wires can be vibrated together with the flexible connection part, that is, a bonding pad connected between the leading wires and the flexible connection part can be vibrated together with the leading wires, so that it can effectively prevent the leading wires to fall and fracture from its connection position to the flexible connection part, thereby improving the reliability of the loudspeaker module, and simultaneously it avoids problems of resonance and large space demand of the module caused by elongated leading wires in the conventional solution.

We have discovered that the leading wires often falls and fractures from the bonding pad in the prior art. Considering that the technical tasks to be carried out by or the technical problems to be solved by the present invention have never been thought of or expected by those skilled in the art, the present invention is a new technical solution.

Further features and advantages of the present application will be more apparent with a review of a detailed description of the exemplary embodiments set forth below with reference to the accompanying drawings.

BRIEF DESCRIPTION OF THE DRAWINGS

The accompanying drawings, which are incorporated in the specification and constitute a part thereof, illustrate the embodiments of the present invention and, together with the description thereof, serve to explain the principle of the present invention.

Figure 1:
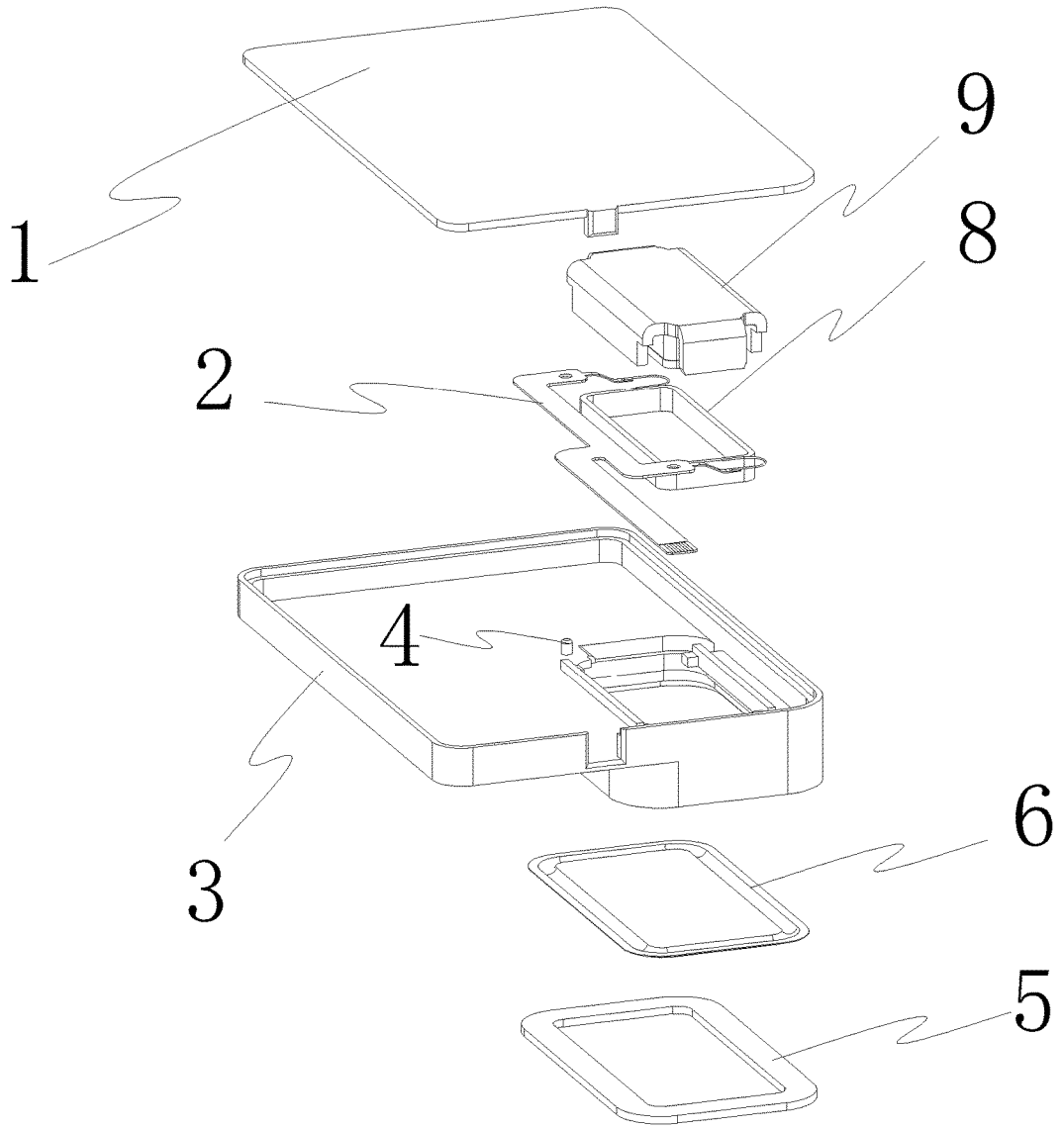
FIG. 1 is an explosive view of loudspeaker module of the present invention.
Figure 2:
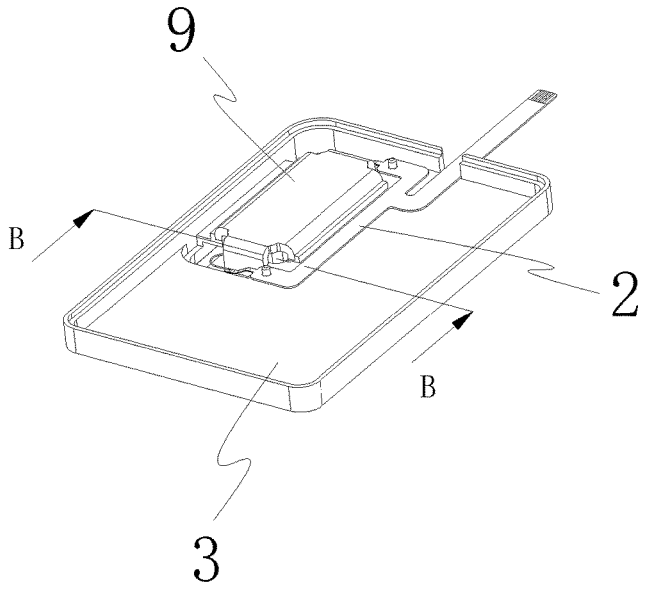
FIG. 2 is a schematic view of inside structure of loudspeaker module of the present invention.

Wherein reference numbers refer to the parts as below:

1—lower shell;

2—FPCB;

3—middle shell;

4—positioning column;

5—upper shell;

6—vibrating diaphragm;
8—voice coil;
9—magnetic circuit system;
10—leading wires;
11—flexible connection part;
110—first planar section;
111—connection section;
112—second planar section;
113—bonding pad of the flexible connection part.

DETAILED DESCRIPTION OF PREFERRED EMBODIMENTS

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

Referring to FIG. 1 to FIG. 4, the present invention provides a loudspeaker module, comprising: an inner cavity enclosed by a shell, a vibrating system and a magnetic circuit system 9, wherein the vibrating system and the magnetic circuit system are installed in the inner cavity of the shell. The magnetic circuit system 9 comprises a basin stand, a magnetic-iron and a washer, wherein the magnetic-iron is located in the basin stand and forms magnetic gaps with the sidewalls of the basin stand. The vibrating system comprises a vibrating diaphragm 6 fixed in the inner cavity and a voice coil 8 for driving the vibrating diaphragm 6 to produce sound, said voice coil 8 is fixed on the vibrating diaphragm 6 and suspends in the magnetic gap between the magnetic-iron and the sidewalls of the basin band; and the central position of the vibrating diaphragm 6 can also be configured with a globe-roof, etc. When the voice coil 8 is energized, the voice coil 8 vibrates under the action of the magnetic circuit system 9, and simultaneously the voice coil 8 drives the vibrating diaphragm 6 to vibrate together, so as to implement the sound-producing of the vibrating diaphragm 6.

In an specific embodiment of the present invention, the shell comprises an upper shell 5, a middle shell 3 and lower shell 1 which are buckled together in sequence, wherein the upper shell 5 is buckled on one side of the middle shell 3, the lower shell 1 is buckled on the other side of the middle shell 3, and they form the inner cavity for installing the magnetic circuit system 9 and the vibrating system.

Figure 3:
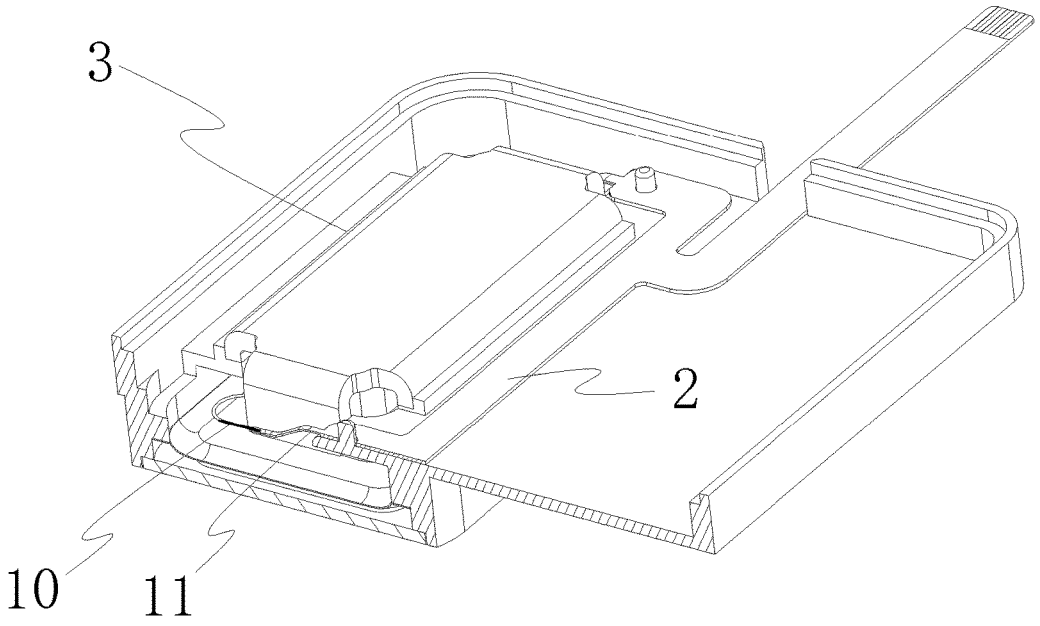
FIG. 3 is a cross-sectional view taken through line B-B of FIG. 2.
Figure 4:
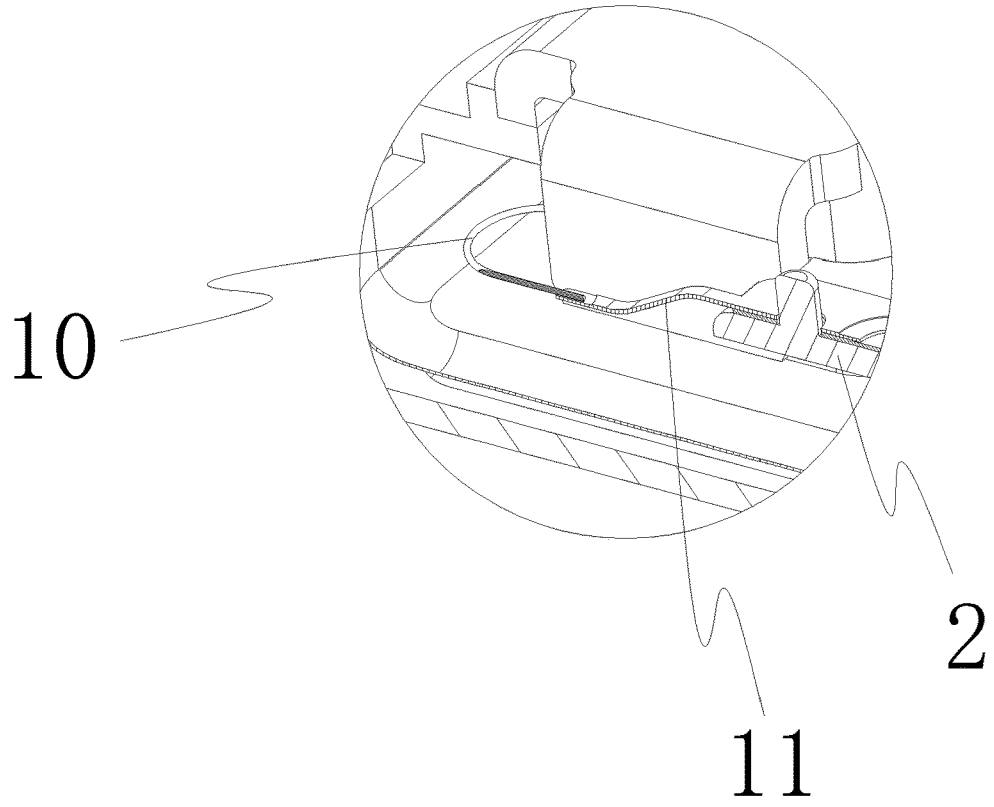
FIG. 4 is a partial enlarged view of connection position between the leading wires and the flexible connection part according to another embodiment of the present invention.

Referring to FIG. 3 and FIG. 4, the loudspeaker module of the present invention further comprises leading wires 10 of a voice coil 8 and a FPCB 2 located in the loudspeaker module. Specifically, the FPCB 2 can install on the middle shell 3.

The loudspeaker module of the present invention further comprises a flexible connection part 11 which is located between leading wires 10 and the FPCB 2 and is used for connecting the leading wires 10 and the FPCB 2. Among others, the free end of said leading wires 10 is connected with one end of the flexible connection part 11, for example, by means of soldering. The other end of said flexible connection part 11 is connected with the FPCB 2. Furthermore, said flexible connection part 11 is suspended in the inner cavity of the shell through the leading wires 10 and the FPCB 2.

In the loudspeaker module of the present invention, the leading wires 10 and the FPCB 2 are connected together by the flexible connection part 11 and the flexible connection part 11 is suspended in the inner cavity of the module. When the voice coil is vibrated, the leading wires 10 can be vibrated together with the flexible connection part 11, that is, it can enable the bonding pad connected between the leading wires 10 and the flexible connection part 11 to vibrate along with the leading wires 10, thereby effectively preventing the leading wires from falling and fracturing at the connection position between the leading wires and the flexible connection part 11, improving the reliability of the loudspeaker module and simultaneously avoiding the problems of resonance and large space demand of the module caused by an elongated leading wires in the conventional solution.

In the present invention, the flexible connection part 11 and the FPCB 2 can be integrated together, which is an extension part extending from an end of the FPCB 2 towards the direction of the free end of the leading wires 10. Certainly, for those skilled in the art, the flexible connection part 11 can be thin steel sheet. The approach of soldering the flexible connection part 11 together with the leading wires 10 can improve vibration effects of the bonding pad and the leading wires therebetween, and it avoids problems of falling and fracturing caused by the rigid connection.

In the loudspeaker module of the present invention, for the convenient of installing the FPCB 2, a positioning hole is configured on the end of the FPCB for connecting the flexible connection part 11, and a prominent positioning column 4 is configured on the corresponding position of said middle shell 3. Among others, said end of the FPCB for connecting the flexible connection part 11 is fixed with the middle shell 3 by means of hot melting or double faced adhesive.

Figure 5:
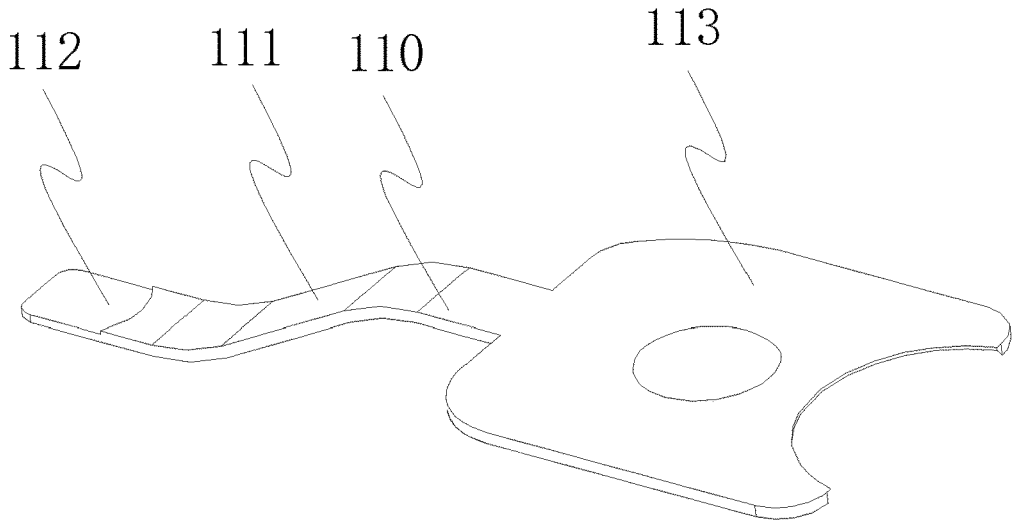
FIG. 5 is a schematic structure view of the flexible connection part according to another embodiment of the present invention.

In the loudspeaker module, as the free end of the leading wires 10 and the FPCB 2 are often not in the same plane, the flexible connection part 11 comprises a first planar section 110 which is substantially located in the same plane with the FPCB 2, a second planar section 112 which is substantially located in the same plane with the free end of the leading wires 10 and a connection section 111 connected the first planar section 110 and the second planar section 112, as shown in FIG. 5. When the flexible connection part 11 and the FPCB 2 are installed separately, the flexible connection part 11 further comprises a bonding pad 113 of the flexible connection part which is located at the end of the first planar section 110, and the flexible connection part 11 is fixed on the FPCB 2 by means of soldering or other methods through the bonding pad 113 of the flexible connection part.

Although some specific embodiments of the present invention have been demonstrated in detail with examples, it should be understood by a person skilled in the art that the above examples are only intended to be illustrative but not to limit the scope of the present invention. It should be understood by a person skilled in the art that the above embodiments can be modified without departing from the scope and spirit of the present invention. The scope of the present invention is defined by the attached claims.

What is claimed is:

1. A loudspeaker module, characterized in that, comprising:

an inner cavity enclosed by a shell;

a voice coil, installed in the inner cavity of the shell;

a Flexible Printed Circuit Board (FPCB), installed in the inner cavity of the shell;

leading wires of the voice coil;

a flexible connection part, located between the leading wires and the FPCB (2);

wherein a free end of the leading wires is connected with one end of the flexible connection part, another end of the flexible connection part is connected with the FPCB, and the flexible connection part is suspended in the inner cavity of the shell through the leading wires and the FPCB, and wherein the flexible connection part comprises a first planar section which is substantially located in the same plane with the FPCB, a second planar section which is substantially located in the same plane with the free end of the leading wires and a connection section connected the first planar section and the second planar section.

2. The loudspeaker module according to claim 1, characterized in that the free end of the leading wires is soldered together with the flexible connection part.

3. The loudspeaker according to claim 1, characterized in that the flexible connection part and the FPCB are integrated together, which is an extension part from an end of the FPCB towards the free end of the leading wires.

4. The loudspeaker module according to claim 1, characterized in that the shell comprises an upper shell, a middle shell and lower shell which are buckled together in sequence, wherein the FPCB is fixed on the middle shell.

5. The loudspeaker module according to claim 4, characterized in that a positioning hole is configured on an end of the FPCB for connecting the flexible connection part, and a prominent positioning column is configured on the corresponding position of the middle shell.

6. The loudspeaker module according to claim 5, characterized in that an end of the FPCB for connecting the flexible connection part is fixed with the middle shell by means of hot melting.

7. The loudspeaker module according to claim 5, characterized in that an end of the FPCB for connecting the flexible connection part is fixed with the middle shell by means of double faced adhesive.

* * * * *